US010443232B2

(12) United States Patent
Heiden

(10) Patent No.: US 10,443,232 B2
(45) Date of Patent: Oct. 15, 2019

(54) INSULATING PANELS FOR FRAMED CAVITIES IN BUILDINGS

(71) Applicant: 2 Hands Insulation Inc., West Linn, OR (US)

(72) Inventor: Joseph Anthony Heiden, West Linn, OR (US)

(73) Assignee: 2 Hands Insulation Inc., West Linn, OR (US)

( * ) Notice: Subject to any disclaimer, the term of this patent is extended or adjusted under 35 U.S.C. 154(b) by 0 days.

(21) Appl. No.: 15/962,417

(22) Filed: Apr. 25, 2018

(65) Prior Publication Data

US 2018/0313078 A1 Nov. 1, 2018

Related U.S. Application Data

(60) Provisional application No. 62/491,131, filed on Apr. 27, 2017.

(51) Int. Cl.

| | |
|---|---|
| ***E04B 1/76*** | (2006.01) |
| ***E04B 1/61*** | (2006.01) |
| ***E04C 2/20*** | (2006.01) |
| ***E04C 2/30*** | (2006.01) |
| ***E04C 2/32*** | (2006.01) |
| *E04B 2/70* | (2006.01) |
| *E04B 1/80* | (2006.01) |
| *E04B 2/58* | (2006.01) |

(52) U.S. Cl.

CPC ..... *E04B 1/7654* (2013.01); *E04B 1/6133* (2013.01); *E04C 2/205* (2013.01); *E04C 2/30* (2013.01); *E04C 2/324* (2013.01); *E04B 1/80* (2013.01); *E04B 2/58* (2013.01); *E04B 2/706* (2013.01); *E04B 2/707* (2013.01); *E04B 2001/7695* (2013.01); *E04B 2103/04* (2013.01)

(58) Field of Classification Search

CPC .. E04B 1/7654; E04B 1/6133; E04B 2103/04; E04C 2/30; E04C 2/205

USPC ..... 52/404.1

See application file for complete search history.

(56) References Cited

U.S. PATENT DOCUMENTS

| | | | | |
|---|---|---|---|---|
| 3,251,382 | A * | 5/1966 | Tatsch | F16L 9/003 138/151 |
| 3,731,449 | A * | 5/1973 | Kephart, Jr. | E04C 2/205 52/631 |
| 3,828,502 | A | 8/1974 | Carlsson | |
| 3,898,779 | A | 8/1975 | Tracy | |
| 4,010,865 | A * | 3/1977 | Wilgus | B65D 1/225 220/6 |
| 4,590,733 | A | 5/1986 | Schneller et al. | |
| 4,835,928 | A | 6/1989 | Scott | |
| 5,165,212 | A | 11/1992 | Arnold | |
| 5,581,969 | A | 12/1996 | Kelleher | |
| 5,675,855 | A * | 10/1997 | Culp | A47C 27/084 5/420 |

(Continued)

FOREIGN PATENT DOCUMENTS

| | | | | |
|---|---|---|---|---|
| DE | 3546385 | A1 * | 7/1987 | A47C 23/02 |

*Primary Examiner* — Jeanette E Chapman

(74) *Attorney, Agent, or Firm* — Ganz Pollard, LLC

(57) ABSTRACT

An insulative panel having a frontside and an opposing backside, and one or more other sides that extend from the frontside to backside, the one or more other sides angling inwardly from the frontside to the backside so that the panel has a tapering profile, the panel being configured to fit into a stud or other such cavity having standardized dimensions, the panel comprising an insulating material with an R-value suitable for use in building construction and remodeling.

19 Claims, 3 Drawing Sheets

(56) References Cited

U.S. PATENT DOCUMENTS 6,935,081 B2 8/2005 Dunn et al.
7,866,105 B2 * 1/2011 Babbitt ..... B32B 5/02 52/404.1
8,016,241 B2 * 9/2011 Moores ..... B64C 1/40 244/119
8,595,870 B1 * 12/2013 Lorenzo ..... A47D 13/063 5/98.1
8,707,634 B2 * 4/2014 Anklam ..... E04H 1/1205 52/79.1
8,793,952 B2 * 8/2014 Olang ..... E04B 1/7604 428/309.9
8,899,519 B2 * 12/2014 Smith ..... B64C 1/40 244/117 R
8,919,082 B1 * 12/2014 Cataldo ..... B65D 81/3816 220/4.29
2005/0188649 A1 * 9/2005 Hagen, Jr. ..... B29C 44/186 52/782.1
2005/0223668 A1 * 10/2005 Thompson ..... B32B 11/06 52/404.1
2007/0283662 A1 12/2007 Rades
2010/0186169 A1 * 7/2010 Kelly ..... A47D 15/008 5/655
2010/0215934 A1 * 8/2010 Fabian Mariezkurrena ..... B29C 44/3446 428/220
2011/0296781 A1 12/2011 McCary
2012/0031957 A1 * 2/2012 Whitaker ..... B32B 3/12 229/103.11
2013/0192146 A1 * 8/2013 Anklam ..... E04H 1/1205 52/79.5
2014/0083037 A1 * 3/2014 McClure ..... E04C 2/46 52/404.1
2014/0109508 A1 * 4/2014 Lippy ..... E04B 1/7654 52/741.4
2017/0233130 A1 * 8/2017 Couture ..... B65D 5/4266 206/503
2018/0112394 A1 * 4/2018 Giles ..... E04B 1/7629

* cited by examiner

INSULATING PANELS FOR FRAMED CAVITIES IN BUILDINGS

CROSS-REFERENCE TO RELATED APPLICATIONS

This application claims benefit of and priority to U.S. Provisional Patent Application No. 62/491,131 filed Apr. 27, 2017, the contents of which is hereby incorporated by reference as if recited in full herein for all purposes.

BACKGROUND

The inventive subject matter is generally directed to rigid foam panels that are adapted to the size and shape of framed cavities in buildings such as stud cavities formed in walls, ceilings, floors, or under roof decks during building construction. More particularly, the panels have features that enable a close conforming fit to the parallel vertical studs defining the cavity, while allowing for easy insertion. For sake of illustration, the inventive subject matter will generally be described in the context of the cavity formed by studs, particularly stud cavities for vertical walls.

Dimensional lumber is lumber that is cut to standardized width and depth, specified in inches. Carpenters extensively use dimensional lumber in framing wooden buildings. Common sizes include 2×4 (also two-by-four and other variants, such as four-by-two in the Australia, New Zealand, and the UK), 2×6, and 4×4. The length of a board is usually specified separately from the width and depth. It is thus possible to find 2×4s that are four, eight, and twelve feet in length. In Canada and the United States, the standard lengths of lumber are 6, 8, 10, 12, 14, 16, 18, 20, 22 and 24 feet (1.83, 2.44, 3.05, 3.66, 4.27, 4.88, 5.49, 6.10, 6.71 and 7.32 meters). For wall framing, "stud" or "precut" sizes are available, and are commonly used. For an eight-, nine-, or ten-foot ceiling height, studs are available in 92⅝ inches (235 cm), 104⅝ inches (266 cm), and 116⅝ inches (296 cm). The term "stud" is used inconsistently to specify length; where the exact length matters, one must specify the length explicitly.

North America softwood dimensional lumber sizes

| Nominal | Actual | | Nominal | Actual | | Nominal | Actual | |
|---|---|---|---|---|---|---|---|---|
| | in × in | mm × mm | | in × in | mm × mm | | in × in | mm × mm |
| 1 × 2 | ¾ × 1½ | 19 × 38 | 2 × 2 | 1½ × 1½ | 38 × 38 | 4 × 4 | 3½ × 3½ | 89 × 89 |
| 1 × 3 | ¾ × 2½ | 19 × 64 | 2 × 3 | 1½ × 2½ | 38 × 64 | 4 × 6 | 3½ × 5½ | 89 × 140 |
| 1 × 4 | ¾ × 3¼ | 19 × 89 | 2 × 4 | 1½ × 3½ | 38 × 89 | 4 × 8 | 3½ × 7¼ | 89 × 184 |
| 1 × 6 | ¾ × 5½ | 19 × 140 | 2 × 6 | 1½ × 5½ | 38 × 140 | 6 × 6 | 5½ × 5½ | 140 × 140 |
| 1 × 8 | ¾ × 7¼ | 19 × 184 | 2 × 8 | 1½ × 7¼ | 38 × 184 | 8 × 8 | 7¼ × 7¼ | 184 × 184 |
| 1 × 10 | ¾ × 9¼ | 19 × 235 | 2 × 10 | 1½ × 9¼ | 38 × 235 | | | |
| 1 × 12 | ¾ × 11¼ | 19 × 286 | 2 × 12 | 1½ × 11¼ | 38 × 286 | | | |

(Source https://en.wikipedia.org/wiki/Lumber)

Lumber's nominal dimensions are larger than the actual standard dimensions of finished lumber.

Metal studs are available in various sized including 1⅝", 2½", 3½", 3⅝", 4", 5½" and 6" widths or web depths.

Wood or steel studs may be spaced at 12", 16" or 24" on-center based on wall height. For purposes of illustrating principles of the inventive subject matter, a 16" on-center spacing will generally be used in the following discussion.

Currently, in the United States and Canada, wood or metal stud framed buildings (buildings built with wood or metal framing vertical members, usually spaced approximately 16" on center, running from floor to ceiling), are insulated by placing fiberglass bat, cellulose, spray foam, or other type of "cavity fill" insulation between the studs in the wall. This kind of framing may also be referred to as "stick built." With increasing environmental regulations, buildings need to be more efficient than in the past. Many of the traditional methods of insulating stick-built buildings no longer meet code for new construction. This has resulted in increases in wall thickness, addition of rigid board to the outside of the building, and the growth of the spray polyurethane insulation market. Polyurethane and polyisocyanurate foams provide approximately double the R-value per inch compared to rigid polystyrene board, fiberglass, and cellulose insulation. When properly installed at appropriate thickness, rigid closed-cell foam is also a vapor retarder and air barrier, which contributes to the efficiency of the building.

Rigid foam boards or panels have been used to fill stud cavities in masonry construction. However, such boards are purely rectangular and are difficult to place into cavities because of variability in the dimensions of the cavities resulting from the wood milling and/or construction variabilities. Such boards must be trimmed to fit into cavities onsite, if they are too large, or they may be too small, leaving significant dead space. Accordingly, conventional rigid foam boards increase construction time and costs and may not adequately insulate.

In view of the foregoing, there is a need for board or panel foam insulation systems that have high R-values and which: (1) can be easily installed in standard stud cavity spacings; (2) adjust for manufacturing and construction variability for a given spacing; and (3) that are inexpensive and easily manufactured.

SUMMARY

The inventive subject matter addresses the foregoing and other needs.

The inventive subject matter is generally directed to rigid foam boards or panels that are adapted to the size and shape of predetermined stud cavities, which are typically vertical or horizontal wood or metal studs spaced 16" on center and which are parallel to one another. The height or length of the cavity may vary. Therefore, the boards may be cut to a desired length. More particularly, the panels may have adjustability features that enable a close conforming fit to the parallel vertical studs defining the cavity, while allowing for easy insertion. In addition to stud cavities in vertical walls, the inventive subject matter also applies to cavities formed by studs, or other such structural members, in floors, ceilings, and sub-roof deck assemblies.

In one possible embodiment, the inventive subject matter is directed to an insulative panel having a frontside and an opposing backside, and one or more other sides that extend from the frontside to backside, the one or more other sides angling inwardly from the frontside to the backside so that the panel has a tapering profile, the panel being configured to fit into a stud or other such cavity having predetermined or standardized dimensions, the panel comprising an insulating material with an R-value suitable for use in building construction and remodeling. For most applications, the R-value will be at least 3.

In the foregoing embodiment and others contemplated herein, the panel may have one or more other sides that include an opposing pair of a left side and a right side and the backside has left and right side edges on its perimeter that are inset from the left and right side edges on the perimeter of the frontside by a predetermined degree dependent on the angling of the opposing pair of the panel's left side and right side.

In the foregoing embodiment and others contemplated herein, the panel may have various geometrical forms, but a generally rectilinear form will be suitable for use with cavities based on standard stud construction.

In the foregoing embodiment and others contemplated herein, the inward angling may be between 88-65 degrees, or thereabout.

In the foregoing embodiment and others contemplated herein, the panel may be at least 10" wide at the frontside. In the foregoing embodiment and others contemplated herein, has a depth defined by the separation of the frontside and backside of least 1.5" to 12". In the foregoing embodiment and others contemplated herein, the panel may consist of an open cell foam material of at least 3" in depth. In the foregoing embodiment and others contemplated herein, the panel may be between 10" to 60" wide at the frontside and may have a depth defined by the separation of the frontside and backside of least 1.5" to 12". In the foregoing embodiment and others contemplated herein, the panel may be between 14" to 18" wide at the frontside and has a depth defined by the separation of the frontside and backside of least 1.5" to 6".

In the foregoing embodiment and others contemplated herein, the panel may consist of an open or closed cell foam material.

In the foregoing embodiment and others contemplated herein, one or more collapsible zones are provided in the panel to define one or more convergeable sections. In the foregoing embodiment and others contemplated herein, the collapsible zone may consist of a cut-out or notch oriented along the longitudinal access of the panel and between the one or more other sides, which sides are a pair of a left side and a right side that are intended to be placed adjacent the left and right sides of a stud cavity. In the foregoing embodiment and others contemplated herein, the collapsible zone may have a collapsible foam section.

In the foregoing embodiment and others contemplated herein, the panel may include a plurality of spaced apart shot holes for accepting a filler material.

In the foregoing embodiment and others contemplated herein, the panel may have a multi-layer construction. In the foregoing embodiment and others contemplated herein, a layer may be disposed as a surface layer on the panel's frontside and/or backside to provide any one more properties selected from the group of: a protective layer, a finish layer, a vapor or moisture barrier, a fire retarding barrier, an adhesive layer for adhering to other materials, a structural reinforcement layer, and/or a wear resistant layer.

In another possible, the inventive subject matter contemplates a method of assembling an insulated structure that includes the steps of placing into a cavity defined by studs or other boundary elements serving as at least one set of spaced apart, opposing sides of the cavity, any of the panels contemplated herein, such that the panel frictionally engages the spaced apart, opposing sides and fits substantially flush with the opening of the cavity. In the foregoing embodiment and others contemplated herein, the studs are wood or metal studs defining a rectilinear cavity. In the foregoing embodiment and others contemplated herein, the studs may be set at a standard 16"×16" on center spacing. In the foregoing embodiment and others contemplated herein, the steps may further include filling gaps or air spaces, if any, with a filler material.

Other embodiments are contemplated in the detailed description below and in the appended Figures, and in the claims, as originally written or amended, the claims as such being incorporated by reference into this Summary.

The foregoing is not intended to be an exhaustive list of embodiments and features of the inventive subject matter. Persons skilled in the art can appreciate other embodiments and features from the following detailed description in conjunction with the drawings.

BRIEF DESCRIPTION OF THE DRAWINGS

The appended figures show embodiments according to the inventive subject matter, unless noted as showing prior art.

DETAILED DESCRIPTION

Figure 1:
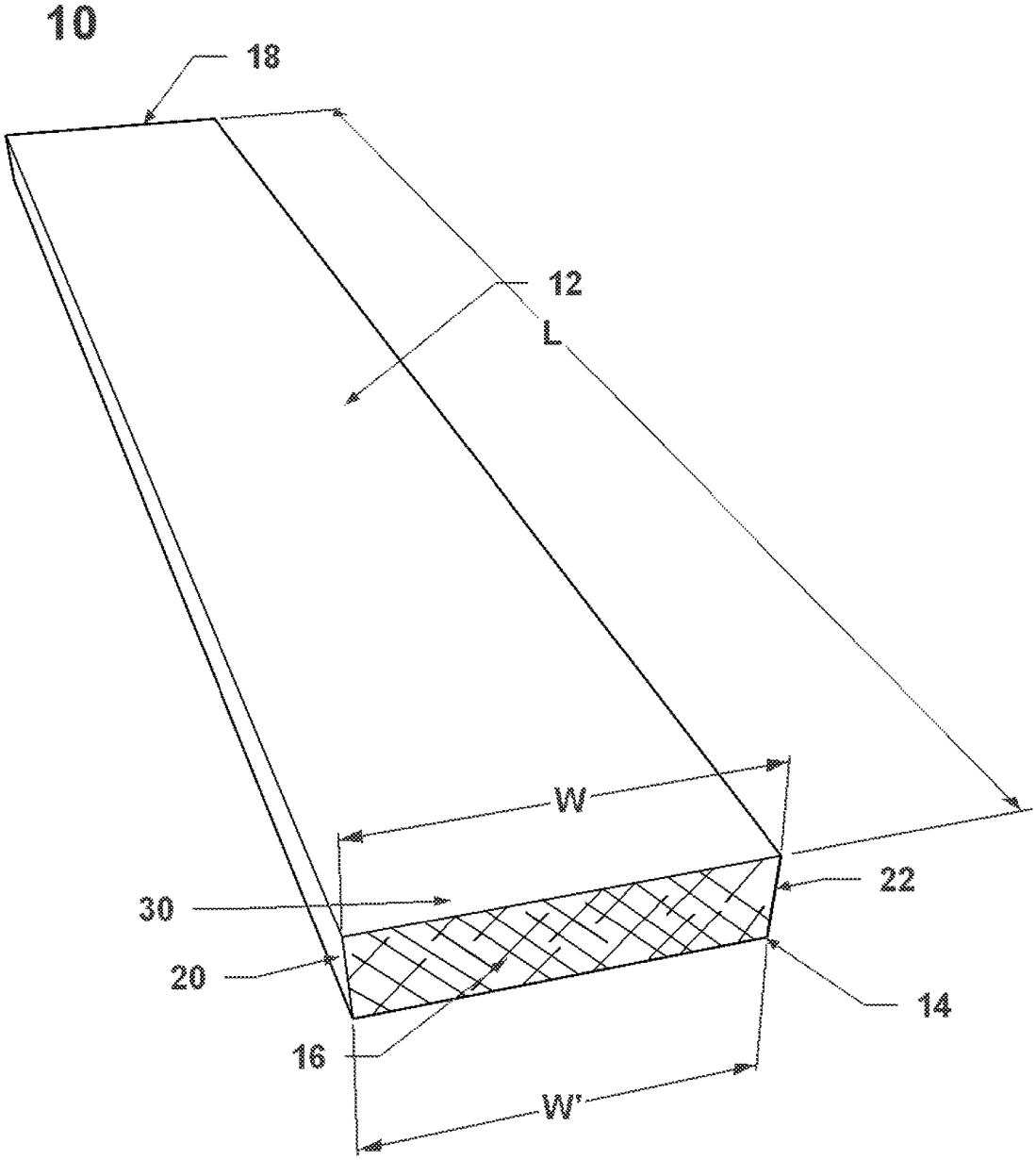
FIG. 1 shows a perspective end view of a panel or board having a tapered form.
Figure 2:
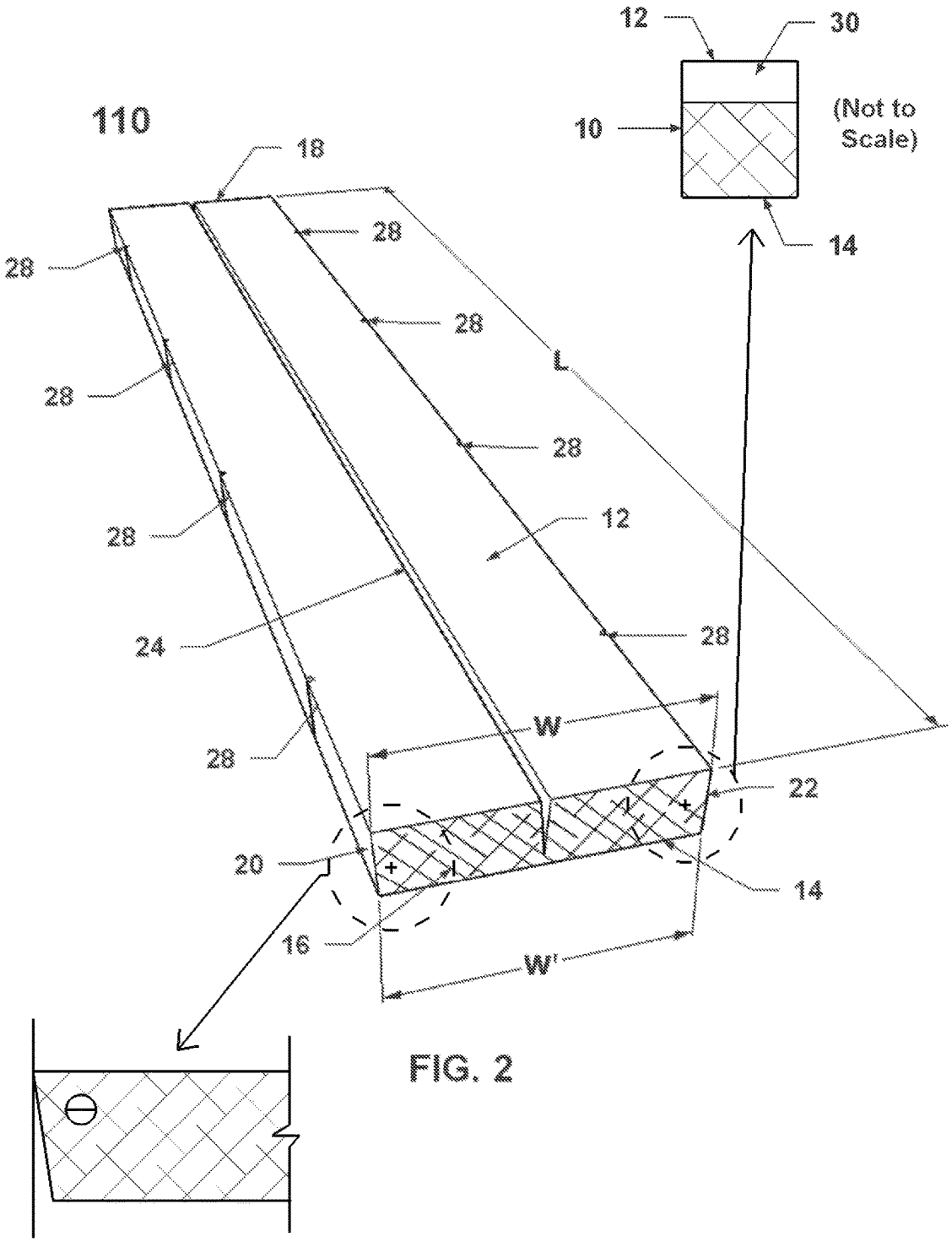
FIG. 2 shows a perspective end view of a panel or board having a tapered form and a collapsible zone.
Figure 3:
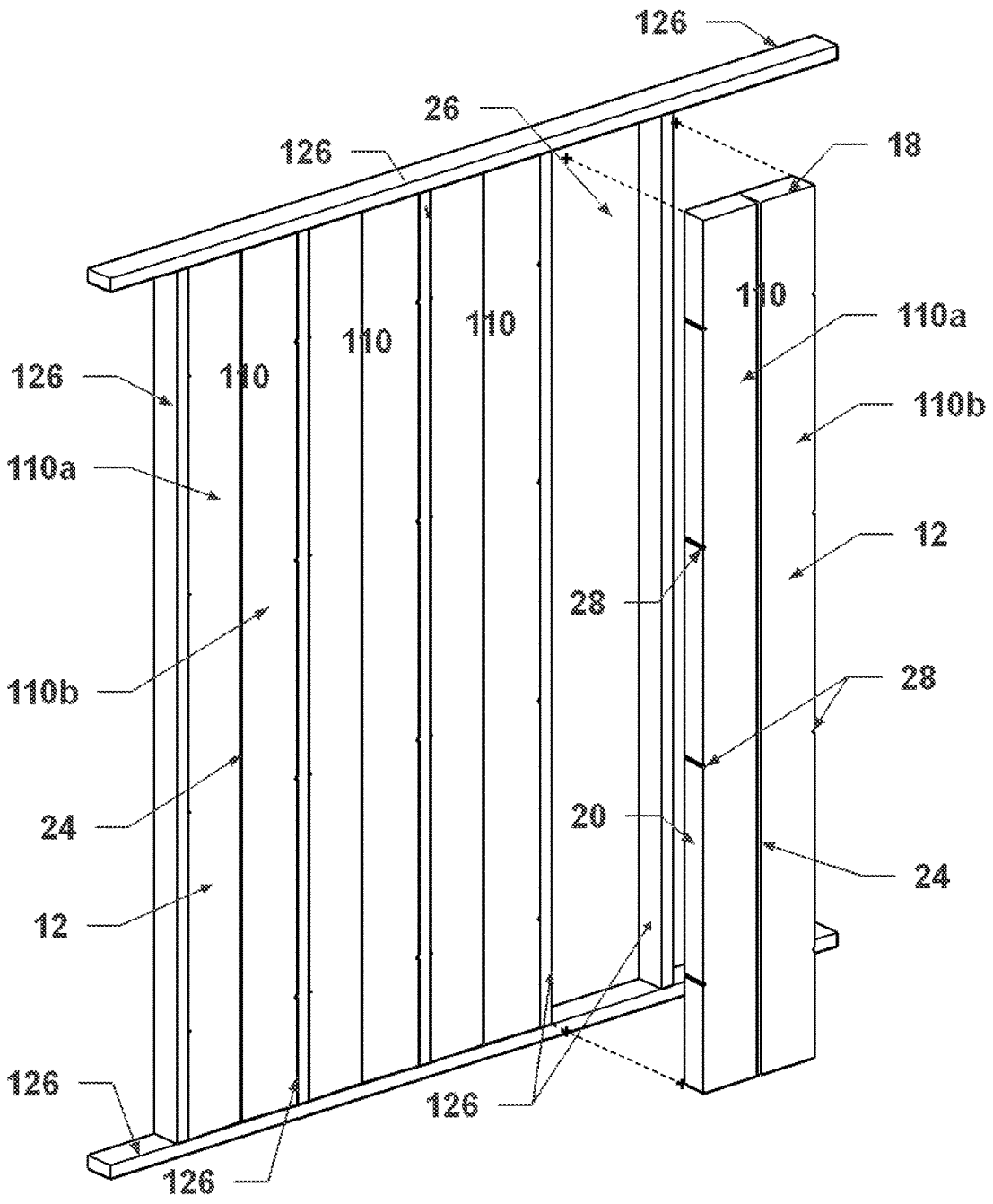
FIG. 3 shows a perspective front view of a set of panels or boards according to FIG. 2 assembled in or being assembled into a set of complementary stud cavities.

Representative embodiments according to the inventive subject matter are shown in FIGS. 1-3, wherein the same or generally similar features share common reference numerals.

The inventive subject matter is generally directed to rigid or semi-rigid foam boards or panels that are adapted to the size and shape of stud cavities or similar building cavities intended for receiving an insulative material. A similar building cavity could be, for example, a rectilinear cavity or channel with parallel walls formed of masonry, concrete, or other bounding elements. More particularly, the panels have features that enable a close conforming fit to parallel vertical studs or parallel horizontal studs defining the cavity, while allowing for easy insertion (as used herein, a "stud" means a wood, metal, or other such structural member that has a straight, elongated form that is usable in forming wall, ceiling, floor, or roofing building assemblies).

As seen in the Figures, the sides of the panels that contact opposing, vertical studs may be tapered so that they are easily inserted into the cavity while still providing a tight fit. In other words, the inward facing surface of the board has a shorter width than the outward facing surface, thereby creating a trapezoidal shape to the board. This basic concept is illustrated in FIG. 1.

Typically, opposing vertical wood or metal studs are spaced 16" on center and are parallel to one another to define lateral margins of a cavity. Any other standard or desired spacing is also contemplated. The height of the cavity may vary. The top and bottom margins of the cavity are normally defined by opposing, parallel studs at right angles with the vertical studs, such as top plates and sole (bottom) plates. However, the top and/or bottom margins may be at angles other than right angles. Therefore, the tops and/or bottom sides of the boards may be cut or formed to a desired length or cut or formed to desired angles. Similarly, the vertical sides may be customized to desired shapes and dimensions, as well as the top and bottom sides.

The cavity may have a depth that is defined by the stud thickness. For example, a nominal 2×4 wood stud has an actual width of 3½". Therefore, opposing, vertical studs will typically define a cavity that is 3½" deep. A panel according to the inventive subject matter is intended to fit generally flush with the front profile of the studs, i.e., the plane of the cavity opening, or perhaps slightly inset, which will hereinafter may be referred to as a "substantially flush fit." While the inventive subject matter typically would use a single panel having a thickness that matches the cavity-defining dimension of opposing studs, the panels may have greater or lesser thicknesses. For example, panels could be provided as different fractions of a cavity depth, e.g., two stacked panels could additively fill a cavity.

Looking particularly at the embodiments of FIGS. 1-3, a panel 10 (or 110 in the embodiment of FIG. 2) has a frontside 12, backside 14, topside 16, bottom side 18, left side 20, and right side 22. Frontside 12 and backside 14 are in parallel planes. Topside 16 and bottom side 18 are in parallel planes. Generally, they would be mirror images of each other. Left side 20 and right side 22 are inwardly angled relative to the frontside and therefore are in transverse planes. Generally, they would be mirror images of each other.

Frontside 12 has a length L and a width W. The length of backside 14 is the same as that of the frontside. But backside 14 has a width W' that is narrower than that of the frontside. Accordingly, the frontside has a perimeter that is greater than that of the backside. Accordingly, the panel perimeter tapers going from the plane of the frontside towards the plane of the backside. This gives the panel an overall 3D trapezoidal form. The shape and dimensions of the frontside are intended to be complementary with the shape and dimensions of the cavity into which it is received to create a close frictional fit, as seen in FIG. 3. The widthwise insetting of backside 14 relative to the frontside 12 means that the panel can be easily placed into a cavity. The tapering of the pairs of sides 16, 18 and/or 20, 22, allows the panel to be pushed into the cavity easily, encountering frictional resistance as the frontside approaches the plane of the cavity. In the embodiment shown in the Figures, sides 16 and 18 are cut or formed at 90-degree angles, and only sides 20, 22 are angled inwardly to provide taper.

In another possible embodiment (not shown), backside 14 may have a shorter length than that of frontside 12 so that all sides of the backside are concentrically oriented within the perimeter of the frontside. In other words, the backside 14 may have a perimeter that is inset from the perimeter of the frontside by an equal distance along all the pairs of corresponding sides of the frontside and backside. This results in topside 16 and bottom side 18 angling inwardly and tapering going from the frontside 12 to backside 14.

From the foregoing it should be apparent that the inventive subject contemplates that any one or more pairs of opposing sides can angle and create a taper in a panel. For example, as is the case for the embodiments of FIGS. 1-3, the top edges and/or bottom edges of frontside 12 and backside 14 coincide in a plane perpendicular to the planes of those sides, and just left side 20 and right side 22 taper going from frontside 12 to backside 14. Or vice versa, the left side and right side could have edges that coincide in a plane perpendicular to the planes of the frontside and backside, with just the top side and bottom sides tapering going from the frontside to the backside.

As used herein, tapering means that relative to the front surface one or more of the pair top side, bottom side, and/or the pair left side, right side angle inwardly from the frontside at an angle θ of less than 90 degrees. In general, the angling needs to be sufficient to allow the backside to easily be placed into a cavity with little or no frictional engagement, the frictional engagement occurring and becoming progressively stronger as the frontside 12 moves toward the plane of the cavity opening. The angling must also minimize dead space following insertion of a panel. In general, for studs that form a cavity 4" deep, the angle may range from 89 degrees to 45 degrees. However, to account for cavity variability, while minimizing dead space, the angles of between 88 degrees to 65 degrees, or thereabout, are suitable. In one suitable embodiment, the angles may be between 87 and 75 degrees, or thereabout.

For example, in a cavity defined by 16" on center stud spacing, the cavity will have a width less than 16". Accordingly, frontside 12 of the panel may have a width of 14.5"-15", or thereabout, to match the opening of the frontside of the cavity. The width may be slightly wider than the standard or ideal cavity to account for possible variation in stud spacing, e.g., a 16¼" on center spacing resulting from assembly variations. The backside of the panel may have a width of 14"-14.5", ore thereabout. The frontside 12 and backside 14 may be provided in desired widths to allow for different cavity-width tolerances, for example, widths could be 14¾" or 14⅞". Likewise, backside 14 could be provided in widths of 14⅛" or 14¼". As described below, panels that have a dimension larger than the corresponding dimension of a cavity can be designed so that the panels can adjust to the actual dimension of a cavity.

In one possible embodiment, seen in FIG. 2, a triangular notch 24 (also referred to as a "collapsible zone", as described in more detail below) has been cut or otherwise formed (e.g., molded) through most the thickness of the panel 110 in the center of the panel. The notch runs longitudinally for the length of the panel. It could also be in the form of discontinuous segments that run the length of the panel. In the embodiment shown, the notch 24 is disposed through at least half or most of the thickness of the panel 110. Other cutouts or notching configurations may be used, as well as the triangular cutout, so long as they allow opposing sections 110*a*, 110*b* of the board on other side of, and adjacent to, the notch 24 to converge toward one another and thereby adjust to a variable width cavity. Therefore, the cutout or notch, or other collapsible zone, allows the boards to have a higher tolerance for cavity-width variance.

In another possible embodiment, instead of a cutout or notch, a band of collapsible material or a collapsible structure may be disposed between convergeable sections 110*a* and 110*b*. Such material may run partially or fully through the depth of the panel body. As the tapered panel is placed into a cavity, the band of collapsible material collapses under the progressively increasing pressure of the frictional fit, allowing the panel to tightly fit into a cavity while minimizing dead space.

As used herein, any such notch, cutout, band of material or structure that allows sections of the panel to converge under the pressure of insertion into a cavity so that the panel adjusts to the size of the cavity may be referred to as a "collapsible zone" 24. Multiple such zones may be formed in a panel. For example, there could be two, three or more parallel collapsible zones 24 spaced across the width and/or length of the panel 110. Such zones could intersect, segmenting a panel. Accordingly, collapsible zones may be patterned on a panel to divide it into any number of convergeable sections, in a uniform or non-uniform manner.

Although, the panels disclosed herein have a generally rectilinear form, they may be configured in any other geometric shape to complement a target cavity. For example, the panels may be shaped as circles, ovals, polygons, e.g., hexagons, octagons, etc.

FIG. 3 shows a perspective front view of a set of panels or boards 110 according to FIG. 2 assembled in or being assembled into a set of complementary stud cavities 26 defined by various vertical studs and horizontal studs 126.

As indicated above, the tapering of a panel will naturally result in some dead space in the cavity. There may also be spacing between the sides of the panels and the studs defining the cavity. Such spaces can be filled with a filler material. Examples include, batt materials, flexible strips, and spray foams. Shot holes 28 optionally may be pre-molded or otherwise formed along the tapering sides of the panels that fit against the vertical studs. The shot holes allow for a fill material, such as a one or two component foam, e.g., urethane foam, to be injected after the panel/cavity assembly step to help ensure that the seal is air tight and to fill any small gaps or dead spaces.

Any panel may have multiple layers of material formed together into a single panel. For example, a layer 30 of a desired material may be disposed as a surface layer on frontside 12 and/or backside 14 to provide any one more properties: a protective layer, a finish layer, a vapor or moisture barrier, a fire retarding barrier, an adhesive layer for adhering to other materials (e.g., a peel and stick adhesive system), a structural reinforcement layer, wear resistant layer, etc. The layer may be bonded, mechanical fastened, co-molded to the base layer of the panel using any of various known means. The layer may be another type of foam, a woven, non-woven textile, a polymer film, or membrane, etc.

The panel according to the inventive subject matter can be made of any known insulative material shapeable into a panel of foam. For example, the panels may be made of a rigid foam such as polyurethane, isocyanurate, expanded or extruded polystyrene or other foamed plastics. In one exemplary embodiment, standard closed cell panels may be made from approximately 2 lb/cubic foot closed cell polyurethane or polyisocyanurate foam. They optionally may have pre-drilled or molded shot holes on the long sides of the panels that, when installed, are adjacent to the stud walls. Approximately ⅜" holes may be placed, for example, approximately every two feet. After a panel is placed into a cavity, foam may be dispensed into the shot holes to assure that the perimeter of the panel is completely sealed against the studs, that no air or moisture may penetrate the wall, and that the thickness of the cavity insulation is consistent across the entire cavity.

In one possible embodiment, an open cell foam panel be made of 0.4-1.0 lb/cubic foot open cell polyurethane foam. Open cell panels need not have the triangle notch or other collapsible zone in the body of the board because it is not necessary as the lower density foam crushes when placed into the cavity. Such a panel may be easily installed, but generally only has approximately half of the R-value per inch of the comparable closed-cell panel.

Combination panels may be made using two or more kinds of foam. For example, a combination panel could be made primarily out of closed cell foam, but it would have ½-1" strips on the long sides of the panels that will make for a tight fit and easier do-it-yourself installation. Such panels may not need a collapsible zone 24.

R-Values

As used herein "R-value" refers to the United States R-value. Around most of the world, R-values are given in SI units, typically square-meter kelvin per watt or m2·K/W (or equally, m2·° C./W). In the U.S. customary units, R-values are given in units of ft2·° F.·hr/Btu. It is particularly easy to confuse SI and U.S. R-values, because R-values both in the U.S. and elsewhere are often cited without their units, e.g., R-3.5. Usually, however, the correct units can be inferred from the context and from the magnitudes of the values since United States R-values are approximately six times larger than SI R-values (more exactly: 5.67 times larger). The conversion between SI and U.S. units of R-value is 1 h·ft2·° F./Btu=0.176110 K·m2/W, or 1 K·m2/W=5.678263 h·ft2·° F./Btu. Therefore, U.S. and SI values (SI values are sometimes written as RSI to avoid confusion can be converted as follows:

$$R\text{-value (U.S.)}=RSI\ (SI)\times 5.678263337$$

$$RSI\ (SI)=R\text{-value (U.S.)}\times 0.1761101838$$

Any patent and non-patent literature cited herein is hereby incorporated by references in its entirety for all purposes.

The principles described above about any particular example can be combined with the principles described in connection with any one or more of the other examples. The previous description of the disclosed embodiments is provided to enable any person skilled in the art to make or use the disclosed innovations. Various modifications to those embodiments will be readily apparent to those skilled in the art, and the generic principles defined herein may be applied to other embodiments without departing from the spirit or scope of this disclosure. Thus, the claimed inventions are not intended to be limited to the embodiments shown herein, but are to be accorded the full scope consistent with the language of the claims, wherein reference to an element in the singular, such as by use of the article "a" or "an" is not intended to mean "one and only one" unless specifically so stated, but rather "one or more". As used herein, "and/or" means "and" or "or", as well as "and" and "or."

All structural and functional equivalents to the elements of the various embodiments described throughout the disclosure that are known or later come to be known to those of ordinary skill in the art are intended to be encompassed by the features described and claimed herein. Moreover, nothing disclosed herein is intended to be dedicated to the public regardless of whether such disclosure is explicitly recited in the claims. No claim element is to be construed as "a means plus function" claim under US patent law, unless the element is expressly recited using the phrase "means for" or "step for".

The inventor(s) reserves the right to claim, without limitation, at least the following subject matter.

The invention claimed is:

1. A rigid insulative panel having:

a frontside and an opposing backside, and one or more other sides that extend from the frontside to backside, the one or more other sides angling inwardly from the frontside to the backside so that the panel has a tapering profile, and one or more collapsible zones in the panel defining one or more convergeable sections, each collapsible zone disposed between opposing rigid sections of the panel, wherein in a first spaced-apart position, the opposing rigid sections define a first width of the frontside and in a second converged position, the opposing rigid sections define a second width of the frontside smaller than the first width, the panel being configured to fit into a building cavity having parallel walls of predetermined dimensions, the panel comprising an insulating material and the panel having an R-value of at least 3 per inch.

2. The panel of claim 1 wherein the one or more other sides comprise an opposing pair of a left side and a right side and the backside has left and right side edges on its perimeter that are inset from left and right side edges on the perimeter of the frontside by a predetermined degree dependent on the angling of the opposing pair of the panel's left side and right side.

3. The panel of claim 2 wherein the panel's perimeter has a generally rectilinear form for both the frontside and the backside.

4. The panel of claim 2 wherein the inward angling is at 88-65 degrees.

5. The panel of claim 2 wherein the panel is at least 10" wide at the frontside.

6. The panel of claim 5 wherein the panel has a depth defined by the separation of the frontside and backside of least 1.5" to 12".

7. The panel of claim 6 wherein the panel comprises an open cell foam material of at least 3" in depth.

8. The panel of claim 5 wherein the panel is between 10" to 60" wide at the frontside and has a depth defined by the separation of the frontside and backside of least 1.5" to 12".

9. The panel of claim 5 wherein the panel is between 14" to 18" wide at the frontside and has a depth defined by the separation of the frontside and backside of least 1.5" to 6".

10. The panel of claim 5, wherein the panel comprises an open or closed cell foam material.

11. The panel of claim 1 wherein the collapsible zone comprises a cut-out or notch oriented along the longitudinal access of the panel and between the one or more other sides, which sides are a pair of a left side and a right side that are intended to be placed adjacent the left and right sides of a stud cavity.

12. The panel of claim 11 wherein the collapsible zone comprises a collapsible foam section.

13. The panel of claim 10 wherein the panel includes a plurality of spaced apart shot holes for accepting a filler material.

14. The panel of claim 1 wherein the panel has a multilayer construction.

15. The panel of claim 14 wherein the layer is disposed as a surface layer on the panel's frontside and/or backside to provide any one more properties selected from the group of: a protective layer, a finish layer, a vapor or moisture barrier, a fire retarding barrier, an adhesive layer for adhering to other materials, a structural reinforcement layer, and/or a wear resistant layer.

16. A method of assembling an insulated structure, placing into a cavity defined by studs or other boundary elements serving as at least one set of spaced apart, opposing sides of the cavity, the panel of claim 1, such that the panel frictionally engages the spaced apart, opposing sides and fits substantially flush with the opening of the cavity.

17. The method of claim 16 wherein the studs comprise wood or metal studs defining a rectilinear cavity.

18. The method of claim 17 wherein the studs are set at a standard 16"×16" spacing.

19. The method of claim 16 further comprising filling a gap or air space in the panel with a filler material.

* * * * *